United States Patent [19]

Yoshida et al.

[11] Patent Number: 4,505,009

[45] Date of Patent: Mar. 19, 1985

[54] SLIDE FASTENER WITH A SEPARATOR ATTACHED THERETO

[75] Inventors: Hiroshi Yoshida; Yoshiharu Yamaguchi, both of Toyama, Japan

[73] Assignee: Yoshida Kogyo K.K., Tokyo, Japan

[21] Appl. No.: 535,790

[22] Filed: Sep. 26, 1983

[30] Foreign Application Priority Data

Sep. 27, 1982 [JP] Japan ..... 57/145926

[51] Int. Cl.[3] ..... A44B 19/38

[52] U.S. Cl. ..... 24/433; 24/434

[58] Field of Search ..... 24/391–398, 24/433–435

[56] References Cited

U.S. PATENT DOCUMENTS

| | | | |
|---|---|---|---|
| 2,115,369 | 4/1938 | Marinsky | 24/434 X |
| 2,146,691 | 2/1939 | Sundback | 24/433 |
| 2,216,794 | 10/1940 | Ulrich | 24/434 |
| 2,217,571 | 10/1940 | Susskind | 24/434 X |
| 2,537,939 | 1/1951 | Murphy | 24/433 X |
| 2,583,386 | 1/1952 | Moehler | 24/433 |
| 3,030,684 | 4/1962 | Johns et al. | 24/434 |
| 3,365,758 | 1/1968 | Hansen | 24/433 X |
| 3,507,013 | 4/1970 | Inazawa | 24/434 |

FOREIGN PATENT DOCUMENTS

| | | | |
|---|---|---|---|
| 147624 | 11/1949 | Australia | 24/434 |
| 143854 | 9/1980 | German Democratic Rep. | 24/433 |

*Primary Examiner*—William E. Lyddane
*Assistant Examiner*—James R. Brittain
*Attorney, Agent, or Firm*—Hill, Van Santen, Steadman & Simpson

[57] ABSTRACT

An improved separable slide fastener of the type including a pair of fastener stringers, a pair of male and female members and a box, said male and female members and said box constituting a separator, is disclosed. Each of the female member and the male member includes at least one notch-shaped pawl which is bent inwardly of the rear surface to extend through the fastener tape until it reach to cut in the core cord whereby it is fixedly secured to the lower end part of the fastener stringer. At least one notch-shaped pawl is bent inwardly of the rear surface of the box and extends through the rear surface of the female member and the associated fastener tape whereby the box is fixedly secured to the female member. The box is preferably formed with longitudinally spaced two pawls. The pawls on the female member are formed in the superimposed state relative to the pawls on the box at the same time when the latter are formed.

5 Claims, 3 Drawing Figures

SLIDE FASTENER WITH A SEPARATOR ATTACHED THERETO

BACKGROUND OF THE INVENTION

1. Field of the Invention

The present invention relates to a slide fastener with a separator attached thereto and more particularly to improvement of a so-called separable slide fastener of the type including a pair of fastener stringers, a pair of male and female members in the form of a rod fixedly secured to the lower end part of each of said fastener stringers and a box to which the lower part of the female member is fixed, said male and female members and said box constituting the separator.

2. Description of the Prior Art

A separator of the prior type used for separable slide fasteners is generally constructed by two components, one of them being an assembly of a female member and a box both of which are integrally connected to one another and the other one being a male member. However, it has been pointed out with respect to the conventional separator that a problem arises when both the male member and the assembly of female member and the box are fixedly secured to the lower end part of each of the pair of fastener stringers with a coupling element in the form of a coil secured to each of the inside edges of a fastener tape. Specifically, in a case where an assembly of female member and box is fixedly secured to the lower end part of one of the fastener stringers and a male member is fixedly secured to the lower end part of the other one prior to slidably fitting a slider onto the fastener stringer, it is impossible to automatically fit the slider onto the fastener stringer due to the existence of the box. On the other hand, in a case where the slider is slidably fitted onto the fastener stringer prior to fixing the assembly of female element and box to the lower end part of one of the fastener stringers and fixing the male member to the lower end part of the other one, there is a tendency to cause such malfunction as entanglement of slider with coupling elements, occurance of damage or injury on coupling element or the like because no guiding means is provided with the fastener stringers.

To assure that a number of slide fasteners are automatically manufactured without any intermittence in a mass production line there has already been proposed a method essentially comprising the steps of preparing a female member and a box separately, fixing the male member to the lower end part of one of the fastener stringers, fixing the female member to the lower end part of the other one, slidably fitting a slider onto the pair of fastener stringers while the latter are coupled to one another and finally fixedly securing the box to the female member. One example of the above-proposed method of attaching a separator to a pair of fastener stringers is disclosed in Japanese Laid-Open Patent No. 69746/78. However, no separator has been technically developed which is suitably employable for practicing the prior method as disclosed above.

SUMMARY OF THE INVENTION

The present invention has been made with the foregoing problems in mind and its object resides in providing an improved separable slide fastener of the type including a pair of fastener stringers, a pair of male and female members in the form of a rod fixedly secured to the lower part of the stringers and a box, said male and female members and said box being prepared separately to constitute a separator, wherein an improvement is made such that the pair of male and female members and the box are fixed in sequence to the lower end part of the fastener stringers at a high speed.

The other object of the present invention is to provide an improved separable slide fastener of the above-mentioned type which assures that a separator is fixedly secured to the pair of fastener stringers.

To accomplish the above objects there is proposed in accordance with the present invention a slide fastener with a separator attached thereto including:

(a) a pair of fastener stringers comprising a pair of fastener tapes and a pair of coupling elements in the form of a coil, each of said coupling elements being fixedly sewn to each of the side edges of the fastener tapes with a core cord threaded through the coil, a predetermined length of the coupling element being removed from fastener stringers at the lower part thereof so that the core cord remains as it is;

(b) the separator comprising a male member and a female member fixedly secured to each of the lower end of the fastener stringers, and a box, the male member being secured to one of the fastener stringers and the female member and the box being secured to the other of the fastener stringers; the improvement consisting in that, (c) the male member includes at least one first pawl which is bent inwardly of its rear surface, said pawl piercing through the associated fastener tape until it reaches the core cord so that the male member is fixedly secured to one of the fastener stringer;

(d) the female member includes at least one second pawl which is bent inwardly of its rear surface, said pawl piercing through the associated fastener tape until it reaches the core cord so that the female member is fixedly secured to the other of the fastener stringers; and (e) the box includes at least one third pawl which is bent inwardly of the rear surface thereof, said pawl piercing through the rear surface of the female member and the associated fastener tape so that the box is fixedly secured to the other of the fastener stringers while the third pawl extends in the superimposed state relative to said second pawl of the female member.

Since the separable slide fastener of the invention is constructed such that fixing of the female member to the associated fastener tape, fixing of the male member to the associated fastener tape and, fixing of the female member to the box are easily and reliably carried out by means of a plurality of notch-shaped pawls which pierce through the fastener tapes up to or into the core cord, a slider is slidably fitted onto the pair of fastener stringers when both the male and female members are fixedly secured to the lower end part of the fastener stringers and thereafter the female member is integrally fixed to the box whereby it is assured that a number of separable slide fastener are manufactured continuously at a high operational speed in a mass production line.

In a preferred embodiment of the invention the box has a thin wall portion on the rear surface thereof so that the at least one notch-shaped pawl is bent inwardly of said thin wall portion. Owing to this arrangement, the pawl extending from the thin wall portion can pierce through the fastener tape with small force imparted thereonto until it pierces through the fastener tape in spite of the fact that the whole box has a predetermined mechanical strength. It is preferable that the box is formed with two pawls which are located in a spaced relation in the longitudinal direction of the fastener tape so as to inhibit turning movement of the box relative to the female member.

In the preferred form of the present invention, the pawls of the female and male members, and the box extend downwardly so that they are strong enough to resist against the downward force which might apply to the female member by the slider during use of the slide fastener.

In a preferred embodiment of the invention the at least one pawl on the female member is formed in the superimposed state relative to the at least one pawl on the box at the same time when the latter is formed and therefore the pawls on both the female member and the box are bent inwardly of their rear surfaces to pierce through the fastener tape. As a result both the box and the female member are firmly secured to the fastener tape while the box is firmly secured to the female member.

Other objects, features and advantages of the present invention will become more clearly apparent from a reading of the following description which has been prepared in conjunction with the accompanying drawings.

BRIEF DESCRIPTION OF THE DRAWINGS

The accompanying drawings will be briefly described below.

DETAILED EXPLANATION OF THE INVENTION

Now, the present invention will be described in greater detail hereunder with reference to the accompanying drawings which illustrate a preferred embodiment of the invention.

Figure 1:
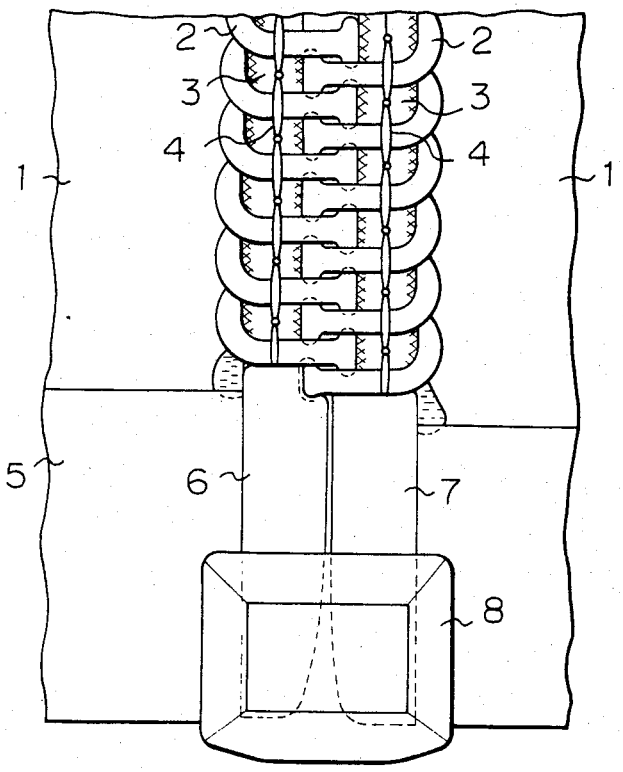
FIG. 1 is a fragmental plan view of a separable slide fastener in accordance with an embodiment of the invention, particularly illustrating a separator comprising a pair of male and female members and a box.
Figure 2:
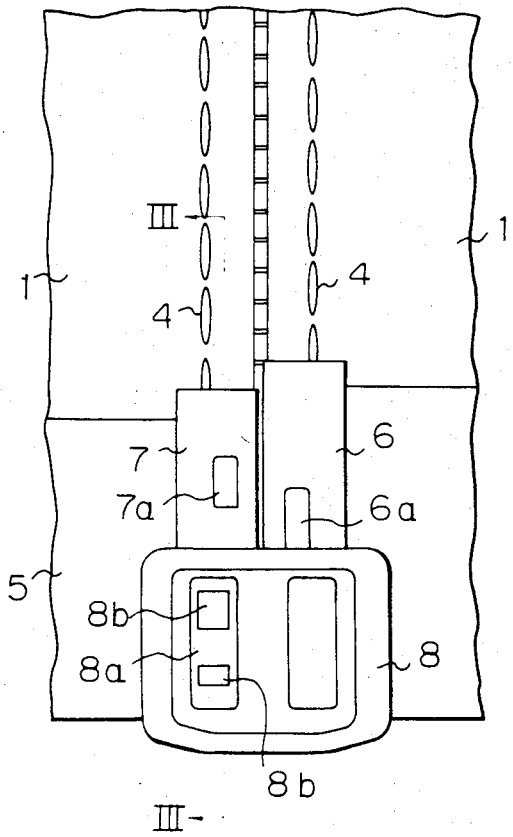
FIG. 2 is a rear view of the separable slide fastener as seen in the opposite direction to that in FIG. 1.

FIG. 1 is a fragmental plan view of a slide fastener with a separator attached thereto in accordance with an embodiment of the invention and FIG. 2 is a rear view of the slide fastener as seen in the opposite direction to that in FIG. 1.

In the drawings reference numeral 1 designates a pair of fastener tapes. A pair of coupling elements 2 in the form of a coil are fixedly secured to the inside edge of each of said fastener tapes 1 by a sewing operation with the use of a thread 4 with a core cord 3 threaded through said coil. A part of the fastener element 2 is removed at the lower part each of the fastener tapes so that the core cord 3 remains on the fastener tape. Both the front and rear surfaces of the lower end part of each of a fastener stringers are lined with a reinforcement film 5 by thermal fusion respectively. The lefthand fastener stringer as seen in FIG. 1 has a male member 6 having a substantially U-shaped cross-sectional configuration fixedly secured to the core portion formed at the lower part of the fastener stringer, whereas the right-hand fastener stringer has a female member 7 having a substantially U-shaped cross-sectional configuration fixedly secured as the same manner. Further, the lower part of the female member 7 is capped with a box 8 and it is then fixed to the latter in such a manner as described later.

Figure 3:
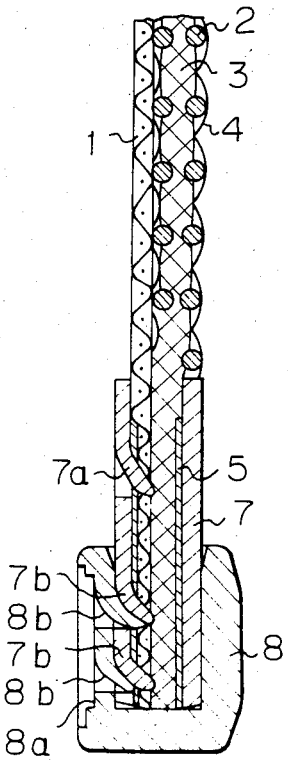
FIG. 3 is a vertical sectional view of the separable slide fastener taken in line III—III in FIG. 2.

Next, description will be made below with reference to FIG. 3 as to how the female member 7 and the box 8 can fixedly secured to the lower part of the fastener stringer. As is apparent from the drawing, the female member 7 has a plurality of notch-shaped pawls $7_a$ and $7_b$ formed on the rear surface thereof in a spaced relation in the longitudinal direction. Specifically, they are bent inwardly of the rear surface of the female member 7 in such a manner that their foremost end parts pierce through the fastener stringer and reach to cut into the core cord 3. Thus, the female member 7 is firmly united with an assembly of three components, that is, the reinforcement film 5, the fastener tape 1 and the core cord 3 at the core section. Further, the box has a thin wall portion $8_a$ on the rear surface so that two notch-shaped pawls $8_b$ are formed on said thin wall portion $8_a$ in a vertically spaced relation. Specifically, they are bent inwardly of the thin wall portion $8_a$ in such a manner that their foremost end parts pierce through the rear surface of the female member 7 and the reinforcement film 5 and reach the fastener tape 1. It should be noted that when the bending of the pawls $8_b$ is carried out the notch-shaped pawls $7_b$ are bent simultaneously from the rear surface of the female member 7 so that their foremost end parts pierce the reinforcement film 5 and the fastener tape 1 and reach to cut in the core cord 3. Accordingly, the pawls $8_b$ of the box 8 and the pawls $7_b$ of the female member 7 are bent together in the two superimposed layers whereby both the female member 7 and the box 8 are firmly secured to the fastener tape 1 so as not to occur the turning movement of the female member 7 relative to the box 8.

The male member 6 is also fixedly secured to the fastener stringer in the same manner as the female member 7. Due to the fact that the male member 6 is not subjected to such heavy loading as that on the female membr 7 a single piece of notch-shaped pawl $6_a$ is adequate to allow the male member 6 to be firmly secured to the fastener stringer. When the male member 6 has one pawl $6_a$, it is preferable that the latter has a length considerably longer than that of the pawls $7_a$, $7_b$ of the female member 7 as shown in FIG. 2 to avoid turning of the male member 6 as much as possible.

Next, description will be made below as to how the separator as constructed in the above-described manner is attached to the fastener stringers.

A pair of coupling elements 2 in the form of a coil is fixedly sewn to the inside edge of each of a pair of fastener tapes 1 by a thread 4 with the core cord 3 being threaded through said coil. A part of the length of the vertically extending coupling elements 2 is cut off by a predetermined distance at a predetermined interval in the longitudinal direction of the fastener tape so that an area where no coupling element is existent is provided. Both the front and rear surfaces of said area on the fastener stringer are lined with a reinforcement film 5 by thermal fusion respectively so that a core portion is formed on the surface of the fastener stringer by using the remaining core cord 3 and thereafter the fastener stringer is cut to a predetermined configuration. Next, a pair of fastener stringers constituting the fastener chain are separated away from one another and one of the fastener stringers is fitted with the male member 6 at its lower end part while the other one is fitted with the female member 7 at its lower end part. This attachment is carried out by bending the notch-shaped pawls $6_a$ and $7_a$ formed on the rear surface of the male member 6 and female member 7 inwardly so that their foremost end parts pierce through each the fastener tapes 1 until they reach to cut in the core cord 3. Thus, both the male and female members 6 and 7 are fixedly secured to the lower end part of each of the fastener stringers. Next, a slider (not shown) is slidably fitted onto the fastener stringers so that the coil element 2 are coupled to one another by sliding movement of said slider. Then, the lower part of the female member 7 is capped with the box 8 and the notch-shaped pawls $8_b$ are bent inwardly of the thin wall portion $8_a$ of the rear surface of the box 8 so that their foremost end parts pierce through the rear surface of the female member 7 and the reinforcement film 5 and at least reach the fastener tape 1. At the same time the notch-shaped pawls $7_b$ are bent inwardly of the rear surface of the female member 7 by the bending of the notch-shaped pawls $8_a$ of the box 8 so that the pawls $7_b$ pierce through the reinforcement film 5 and the fastener tape 1 until they reach to cut in the core cord 3.

Each of the above-mentioned steps of operation can be easily carried out at a high operational speed without any fear of causing malfunctions such as mechanical failure, unexpected stoppage or the like and therefore manufacturing facilities for separable slide fasteners of the invention can be automatically operated at a high operational speed.

While the present invention has been described above merely with respect to a single preferred embodiment, it should of course be understood that it should not be limited only to this and that various changes or modifications may be made in a suitable manner without any departure from the spirit and scope of the invention.

What is claimed is:

1. In a slide fastener with a separator attached thereto including:

(a) a pair of fastener stringers comprising a pair of fastener tapes and a pair of coupling elements in the form of a coil, each of said coupling elements being fixedly sewn to each of the side edges of the fastener tapes with a core cord threaded through the coil, a predetermined length of the coupling element being removed from fastener stringers at the lower part thereof so that the core cord remains as is;

(b) the separator comprising a male member and a female member fixedly secured to each of the lower end of the fastener stringers, and a box, the male member being secured to one of the fastener stringers and the female member and the box being secured to the other of the fastener stringers; the improvement consisting in that, (c) the male member includes at least one first pawl which is bent inwardly of the rear surface of the male member, said first pawl piercing through the associated fastener tape until said first pawl reaches the core cord so that the male member is fixedly secured to one of the fastener stringers;

(d) the female member includes at least one second pawl which is bent inwardly of the rear surface of the female member, said second pawl piercing through the associated fastener tape until said second pawl reaches the core cord so that the female member is fixedly secured to the other of the fastener stringers; and (e) the box includes at least one third pawl which is bent inwardly of the rear surface of the box, said third pawl piercing through the rear surface of the female member and the associated fastener tape so that the box is fixedly secured to the other of the fastener stringers while the third pawl extends in the superimposed state relative to said second pawl of the female member.

2. In a slide fastener with a separator attached thereto as defined in claim 1, wherein said first, second and third pawls extend downwardly in the longitudinal direction of the slide fastener.

3. In a slide fastener with a separator attached thereto as defined in claim 1, wherein the box includes two third pawls in a spaced relation in a longitudinal direction on the rear wall thereof and the female member also includes at least two second pawls on the rear wall thereof at the position corresponding to the position where the third pawls are formed.

4. In a slide fastener with a separator attached thereto as defined in claim 3, wherein the two second pawls on the female member are formed while superimposed relative to the two third pawls on the box and at the same time as the latter are formed.

5. In a slide fastener with a separator attached thereto as defined in claim 1, wherein the box has a thin wall portion on the rear surface thereof and the at least one third pawl is bent inwardly of said thin wall portion.

* * * * *